US006110317A

United States Patent [19]

Sandor

[11] Patent Number: 6,110,317

[45] Date of Patent: Aug. 29, 2000

[54] DECORATIVE DESIGN METHOD AND PRODUCTS

[76] Inventor: Raymond P. Sandor, 3435 Aviation Blvd., Vero Beach, Fla. 32960

[21] Appl. No.: 08/986,149

[22] Filed: Dec. 5, 1997

Related U.S. Application Data

[63] Continuation-in-part of application No. 08/717,939, Sep. 23, 1996, abandoned.

[51] Int. Cl.[7] ..... B44C 1/165

[52] U.S. Cl. ..... 156/235; 156/239; 156/241

[58] Field of Search ..... 156/235, 257, 156/240, 241, 278, 277, 289, 239

[56] References Cited

U.S. PATENT DOCUMENTS

| | | | |
|---|---|---|---|
| 1,832,531 | 11/1931 | Close | 156/241 X |
| 1,893,384 | 1/1933 | Werner | 156/241 |
| 1,895,419 | 1/1933 | Mitchell et al. | 156/241 X |
| 1,897,875 | 2/1933 | Werner . | |
| 1,998,638 | 4/1935 | Reese . | |
| 1,999,413 | 4/1935 | Hemming et al. | 156/241 X |
| 3,485,696 | 12/1969 | Hammunds | 156/247 |
| 3,607,526 | 9/1971 | Biegew | 156/235 |
| 3,810,673 | 5/1974 | Lutje | 154/95 |
| 4,383,878 | 5/1983 | Young et al. | 156/235 |
| 4,839,230 | 6/1989 | Cook . | |
| 4,900,597 | 2/1990 | Kurtow | 156/236 |
| 5,142,722 | 9/1992 | Kolb . | |
| 5,186,787 | 2/1993 | Phillips et al. | 156/241 X |
| 5,273,787 | 12/1993 | Gnatowski . | |

*Primary Examiner*—Gary P. Straub
*Attorney, Agent, or Firm*—Carroll F. Palmer

[57] ABSTRACT

A new method for the production of decorative designs on substrates, e.g., furniture and building walls, basically includes the steps of (a) providing a design printed on a flat release sheet, the design comprising a picture side in contact with the release surface and an exposed back side, (b) applying to an exposed surface of a substrate an imprint layer of imprint material, (c) contacting the exposed back side of the printed design with the external surface of the substrate layer, (d) imprinting the design into the substrate layer, and (e) removing the release sheet leaving the design imprinted in the layer with its picture side exposed. Alternatively, the method may include the step (f) of covering the picture side and any portion of the substrate imprint layer not covered by the design with a clear durable coating. An embodiment using two or more designs on separate release sheets with seriatim imprinting to produce dimensional effects is disclosed.

11 Claims, 1 Drawing Sheet

DECORATIVE DESIGN METHOD AND PRODUCTS

CROSS REFERENCE TO RELATED APPLICATION

This application is a continuation-in-part to application Ser. No. 08/717,939, filed Sep. 23, 1996, now abandoned.

BACKGROUND OF THE INVENTION

1. Field of the Invention

This application relates to a new method for the production of decorative designs on substrates and to new decorative products. More particularly, it concerns a unique decoration method wherein a design or designs printed in mirror image on one or more release sheets are transferred onto a prepared surface of a substrate in a manner that obtains a durable, decorated substrate surface.

2. Description of the Prior Art

There are a variety of methods for creating decorative designs on furniture, walls, ceilings, and other rigid surfaces. The most historic method creates the design by an artist painting it on the surface to be decorated. However, this is labor intensive so the required time and expense creates demand for less labor intensive methods for production of decorated products. This has resulted in development of a number of schemes that involve the creation of a decorative design independently of the surface to be decorated and its transfer then onto such surface, e.g., use of decalcomanias. Further examples of substrate decoration using image transfer are disclosed in the following U.S. patents:

| |
|---|
| 1,893,384 |
| 1,897,875 |
| 1,998,638 |
| 2,810,673 |
| 3,485,696 |
| 3,607,526 |
| 4,383,878 |
| 4,900,597 |
| 5,186,787. |

The prior known decorative design methods that comprise transfer of a prepared image carried on a support sheet to a substrate are faulted in one way or another and the present invention mitigates or totally avoids such faults.

In the decoration of substrates with decalcomanias, the print and a permanently attached support web are transferred onto the substrate. The support web invariably has sufficient thickness that a "edge" outlines the transferred design which is discernable to the discriminating viewer of the decorated substrate. This causes the resulting product to possess a "cheap look" which seriously detracts from its esthetic appearance. The present invention eliminates this decal problem and creates decorative products devoid of any descendible demarcations between the applied design and the remainder of the surface bearing the design so the end product has a "hand painted" look.

In the decoration of substrates with imitations of wood and tarsia style coatings using a transfer method as disclosed in U.S. Pat. No. 1,893,384, the final design presented to a viewer is the reverse of the picture side of the original picture whereby such prior art method renders a distortion of the original design, particularly where it contains text. The present invention enables decorative designs to be created on a substrate by a transfer method which eliminates such prior art distorations.

OBJECTS

A principal object of the invention is the provision of new methods for the production of decorative designs on substrates by image transfer.

Further objects include the provision of:

1. Unique decorative products bearing ornamental designs that appear to have been hand painted.

2. A new decorative design production method that transfers image from a release sheet onto a substrate surface to produce an undistorted image on such surface.

3. Such a design production method wherein multiple image prints may be applied to the substrate surface with only those portions of the subsequently applied prints that extend beyond the peripheries of any previously applied prints forming a dimensional effect in the final positive image created on the substrate surface.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of a new method for the production of a decorative design on a substrate which comprises the steps of (a) providing a design printed on a flat release sheet having a release surface, the design comprising a flat positive image first surface in contact with the release surface and an exposed flat mirror image second surface, (b) applying to an exposed surface of a substrate a layer of imprint material defined by a periphery and an external surface, (c) contacting the mirror image second surface with the external surface, (d) imprinting the design into the layer and (e) removing the release sheet leaving the design imprinted in the layer with the positive image first surface of the design exposed.

In some preferred embodiments, the above described method includes the additional step of (f) covering the first surface and any portion of the imprint layer not imprinted by the design with a clear durable coating. Such clear durable coating is formulated so that, if desired, it may be spread beyond the boundaries of the imprint layer. Thus, typically the imprint layer and its contained design will cover only a portion of a table top and, instead of only applying the clear durable coating to the imprint layer, such coating will be applied to the entire table top or like surface being ornamented in accordance with the invention.

Also, in preferred embodiments, the flat release sheet bearing the printed design is transparent, as opposed to being opaque.

In the above paragraphs and throughout the following discussion and appended claims, it should be understood that the statement "flat positive image first surface in contact with the release surface" means that the picture side of the transfer image is in contact with the release sheet that supports it whereby upon transfer of such image to the substrate to be decorated, such picture side will face up from the substrate. As a result, the resulting decorative design will be undistorted to a viewer, e.g., any text therein will be readable to the viewer.

By way of examples, the release sheet comprises a release coating of silicone material, typical substrates are a portion of a piece of furniture or a building wall, the imprint material is an acrylic polymer and the external surface of the layer is slightly adhesive, e.g., it has a peel adhesion value of about 1–5 oz/in.

As an assist in the method, a sealing coat may be applied to the exposed surface of the substrate prior to the applying of the layer of imprint material.

The design image is prepared by a color copying process using a so-called toner color coping machine that uses dry powder inks that are positioned by electric charge, then heat melted and fused during the printing process, e.g., a Canon CLC 700® copier. Alternatively, the design image may be prepared so-called ink jet printers, i.e., a printer that uses solid ink and with heat to liquefy the solid wax ink so the printing is accomplished by spray jet, e.g., a Tektronix Phaser 600/B solid ink large format printer manufactured by Tektronix Inc.

Such printers are used along with a desktop color graphics computer and a digital laser line scanner enabling original artwork to be converted into a imprint design image in mirror form within the computer and sent to the printer for processing and printing.

In accordance with the invention, the printing is accomplished upon a release sheet, advantageously a silicone type release sheet, e.g., "Akrosi] Silox SC Silox G1P/O" supplied by International Paper Inc. or Flex mark Spec 50K-Liner supplied by Flexcon Inc. These release sheets are clear plastic webs coated with a silicone release agent. Opaque paper base release sheets may be used, but the transparent type sheets are preferred. Thus, to make the transfer image visible during the imprinting process, the release sheet should be translucent or clear in order to view the position of the image on the substrate while being transferred. If the picture image is not visible through the release paper, the exact placement by viewing the image upon a substrate is obscured. Large format design images can be custom created and transferred in many segments because of this exact viewing of the picture placement through the release paper feature in accordance with the invention.

In the new methods of invention, the design image should be protected after its creation on the release sheet because such printed image is loosely attached to the slippery release paper. Therefore, a sheet of release paper is placed release side face down upon the design image and is stapled or taped to the image bearing release sheet along at least one edge to keep this protective sheet from moving relative to the image sheet. The protection sheet provides little friction during shipment and protects the image. In this manner, it is possible to produce the design image bearing release sheet at one location or station and protect the image during shipment to another location or station. For example, in decorating the wall of a building using the complete method of the invention, the image bearing release sheets will typically be prepared at a location separate from building containing the wall to be decorated.

With the image bearing release sheet or sheets provided in accordance with the invention, a liquid imprint coating material of the invention is applied to a surface in the general area where one would desire to decorate with artwork. After about 30 minutes this imprint material becomes tacky and is ready to be imprinted with the design image. Accordingly, the protection release sheet is removed from the design image release sheet. By looking through such transparent sheet, one can see how the design image will actually appear after it is transferred. The design image is lightly placed on the tacky surface material and gently arranged to its exact position. Then, at least one edge of the release paper carrying the design image is taped in place so that it does not move while being transferred. Next, using a burnishing tool, the back of the transfer sheet containing the picture image is rubbed with firm, but not excess pressure in order to transfer the image. A suitable burnishing tool is the flat or rounded edge of a paint mixing stick. If the design image bearing sheet is taped only on one edge, one may view the progress of the imprint process and even choose to leave sections out of the picture for an antique look, or other reasons by gently lifting the paper from time to time to watch the progress of the transfer. The position of the design image sheet should stay in place by tape on at least one edge in order to view how the Imprint process is progressing in this manner.

After the burnishing and imprinting is completed, the release sheet and tape are removed, leaving the positive design image firmly imprinted in the substrate. Another picture image may be imprinted to the unused area of the tacky surface such as described in more detail below.

The success of the invention is made possible, in part, by the provision of clear liquid transfer compositions that dry to the required degree of tack in about 30 minutes for use in the transfer process. Such material becomes and remains in a tacky state for many days, but is forced to dry after the application of the clear seal coat in accordance with the first varation discussed herein.

The success of the invention is further made possible, in part, by the provision of clear liquid transfer compositions that that make resin latex paint tacky and able to accept the imprint design image in accordance with the second varation described herein. A preferred latex paint material is made with Morton International Inc. MORFLO 1200 styrene latex with a resin content above 20% solids. When a new tackifing transfer liquid composition of the invention is applied to such latex paint, it makes the paints resin tacky and it stays tacky for about 2 to 4 hours. Afterwards, the latex paint loses its tack and then it can not be transferred upon. With the use of this new imprint material applied in accordance with the invention, a drying top coat is not required to dry the tackiness after the imprint steps are completed.

In some embodiments, a plurality of different designs printed on release sheets are provided, first of the plurality is imprinted into the layer and thereafter a second of the plurality has a portion thereof imprinted into the layer while another portion thereof overlaps the first of the plurality. This overlap portion does not become a final part of the decoration method, i.e., it becomes a discarded item along with the associated release sheet.

The invention further provides as new articles of manufacture, decorative designs on a substrate produced by the unique method described above. For example, such new articles may be a piece of decorated furniture, a decorated wall of a building, or a variety of other decorated articles of manufacture.

The new methods of the invention can be divided into two variations depending on the specific nature of the layer of imprint material applied to the substrate surface prior to the tranfer of the design image thereto. In either variation, the imprint material is a spreadable clear liquid which can be applied by brush or spray to create a slightly tacky layer having a thickness typical to that obtained in an normal painting operation, e.g., 1–3 mm., and having a peel adhesion value of about 1–5 oz/in. In the first variation, the tackiness of the imprint material layer is permanent, while in the second variation the tackiness is transitory, i.e., in between about 1–4 hours the tackiness disappears. In such first variation, it is necessary that step (f) mentioned above be used to to complete the oramentation of the substrate, while in the second variation this step (f) is optional, i.e., it may be eliminated.

There is a tradeoff in selection of which of the first or second variations will be used in decoration of a substrate, i.e., the first variation is applicable to a wider range of substrates than the second variation, but requires the additional step (f).

In conducting the new methods of the invention under the first variation a substrate with most any relatively smooth finished surface can be used. An unfinished surface, e.g., raw, unpainted wood, should be prefinished such as by application of a primer coat and, advantageously, at least one coat of paint, varnish or the like. In this first variation, the imprint material is a liquid composition capable of being applied to a substrate surface as a layer of about 1–3 mm. in depth and which exhibits as tackiness corresponding to a peel adhesion value of 1–5 oz/in. The tackiness of this layer is permanent, so after the desired image has been transferred to and imbedded therein, a clear finish coating is applied to the entire area defined by the of the imprint material layer, including the transferred image located within such periphery. Such finish coating can be any commercially available clear lacquer or like liquid coating composition which is compatible with the imprint material layer and does not injure the transferred image, e.g., does not cause what it covers to wrinkle, crack or the like. In other words, this finish coating step is similar in procedure and choice of clear coating composition to conventional clear coat finishing requirements of material compatability and application.

Imprint materials for use with the first variation are typically clear liquid compositions capable of being applied by brush or spray in the manner of conventional paints and lacquers, i.e., to obtain a uniform thickness of about 1–3 mm. They are formulated to create a permanently, mildly tacky coating on the substrate, i.e., tackiness corresponding to a peel adhesion value of 1–5 oz/in. Also, they are formulated to be malleable to enable the design image applied thereto from the release sheet to be imprinted therein by reasonable manipulation of the design image through the release sheet. Advantageously, the imprint material when applied to the substrate will be able to be indented by the particles of wax, resin or the like that form the design image present on the release sheet by mild surface manipulation, e.g., hand rubbing the back of the release sheet with a burnishing tool with mild pressure, typically 1–10 lbs. of pressure.

In the second variation, the substrate to which the imprint material is applied must be capable of interacting with the imprint material to provide the required tackiness to receive the transferred design image. In essence, such imprint material is a mildly volatile liquid which softens the surface of the substrate to create the needed tackiness, but as such liquid evaporates, the tackiness disappears restoring the treated substrate surface to its initial non-tacky quality. In accordance with the invention, substrates to which the second variation of the new method are applied are those which have been coated with a latex type paint containing at least 20 percent by weight of resin content selected from acrylic, polyvinyl chloride and polyvinyl acetate resins. Such latex type paints are a commercially available class of paint in contrast to the other conventional solvent base class of paints.

In accordance with the invention, the second variation may be applied to an existing substrate that has been previously coated by a third party with the stated latex type paint, e.g., the pre-painted wall of a building. Alternatively, if the substrate is not already coated with such latex type paint, a first step in the new decoration method will be to coat at least that area of the substrate to be decorated with a layer of the stated latex type paint.

The invention provides unique liquid compositions to be used as the imprint material capable of interacting with the latex type paint substrate surface in the inital step of the new decoration methods to produce a tacky surface. Such unique liquid compositions are clear to milkly appearing mixtures of (a) alkylene glycol ethers and/or esters having a volatily less than that of water and (b) thickeners therefor. Typically, such liquid compositions when applied as layer of about 1–3 mm. to a substrate coated with the above stated latex type paint will be tacky within 4 hours, particularly 2–4 hours, at room temperature, i.e., 75–80° F. A preferred group of such compositions comprise between 20 and 40 percent by weight alkylene glycol ether, 10 and 25 percent by weight alkylene glycol ester and 0.5 and 10 by percent weight thickeners therefor, the remainder being essentially water, i.e., water which may contain a 0.01–1 weight percent pH adjustment reagent.

Imprint materials used with the second varation will, like those used in the first varation, be capable when applied to the substrate to be indented by the particles of wax, resin or the like that form the design image present on the release sheet by mild surface manipulation, e.g., hand rubbing the back of the release sheet with a burnishing tool with mild pressure, typically 1–10 lbs. of pressure.

In one embodiment of the new decorative design production methods of the invention, unique dimensional effects can be obtain by use of a plurality of release sheets bearing different images and applying these seriatim with partial overlap leaving only the overlapped portions of subsequent designs as a permanent part of the final decoration on the finished decorated article. A method of this type using two release sheets comprises the steps of (1) providing a first release sheet bearing a first design, (2) providing a second release sheet bearing a second design, and (3) providing a substrate, e.g., the top of a table.

The first flat release sheet typically is defined by a first sheet periphery, a first release surface and a first back surface. Such sheet bears a first printed design comprising a first flat positive image surface in contact with the first release surface and an exposed first flat mirror image surface, The second flat release sheet typically is defined by a second sheet periphery, a second release surface and a second back surface. Such second sheet bears a second printed design comprising a second flat positive image surface in contact with the second release surface and an exposed second flat mirror image surface.

Using the first release sheet, the method comprises (4) applying to an exposed surface of the substrate a layer of the imprint material defined by a layer periphery and an external surface, (5) positioning the first release sheet to overlay the layer of imprint material with the first design within the layer periphery and the first flat mirror image surface facing the external surface, (6) securing a portion of the first release sheet periphery relative to the layer periphery leaving the remainder of the first release sheet movable relative to the external surface of the layer, (7) contacting the first flat mirror image surface with the external surface, (8) imprinting the first design into the layer by applying pressure to the first back surface of the first release sheet, and (9) removing the first release sheet leaving the first design imprinted in the layer and the first positive image surface of the design exposed.

Using the second release sheet, the method further comprises (10) positioning the second release sheet to overlay the layer of imprint material with the second design within the layer periphery and the second flat mirror image surface facing the external surface, (11) securing a portion of the second release sheet periphery relative to the layer periphery leaving the remainder of the second release sheet movable relative to the external surface of the layer, (12) contacting at least part of the second flat mirror image surface with the external surface, (13) imprinting the at least part of the second design into the layer by applying pressure to the back surface of the second release sheet, (14) removing the second release sheet leaving the at least part of the second design imprinted in the layer and the only a portion of the second positive image surface of the design exposed, and (15) covering with a clear durable coating the first positive image surface, the at least part of the second design and any portion of the layer not imprinted by the first and second designs.

Typically the substrate surfaces decorated in accordance with the invention are flat. However, surfaces of mild curvature that do not cause extensive creasing of the release sheet during the design application can be successfully decorated.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein.

DESCRIPTION OF THE PREFERRED EMBODIMENTS

Figure 1:
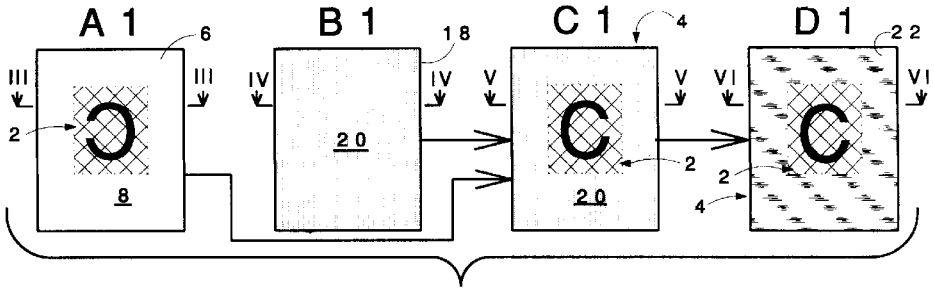
FIG. 1 is a diagrammatic representation of the steps of a basic embodiment of the new method of the invention showing plan views of various involved items.

For a detailed description of the invention, reference is made to the drawings illustrating in FIG. 1 and sectional views 3–6 a basic embodiment of a method of the invention for the production of a decorative design 2 on a substrate 4 comprises providing, in step A1, design 2 printed on a flat release sheet 6. Sheet 6 has a release surface 8 and the design 2 has a flat positive image first surface 10 in contact with the release surface 8 and an exposed flat mirror image second surface 12.

In step B1, one applies to an exposed surface 14 of substrate 4, a layer 16 of imprint material defined by a periphery 18 and an external surface 20.

In step C1, one contacts the mirror image second surface 12 with the external surface 20 and imprints the design 2 into the layer 16, followed by removing the release sheet (not shown in step C1), leaving the design 2 imprinted in the layer 16 with the positive image surface 10 of the design 2 exposed.

In step D1, one covers the design surface 10 and any portion of the layer 16 not imprinted by the design 2 with a clear durable coating 22.

Figure 2:
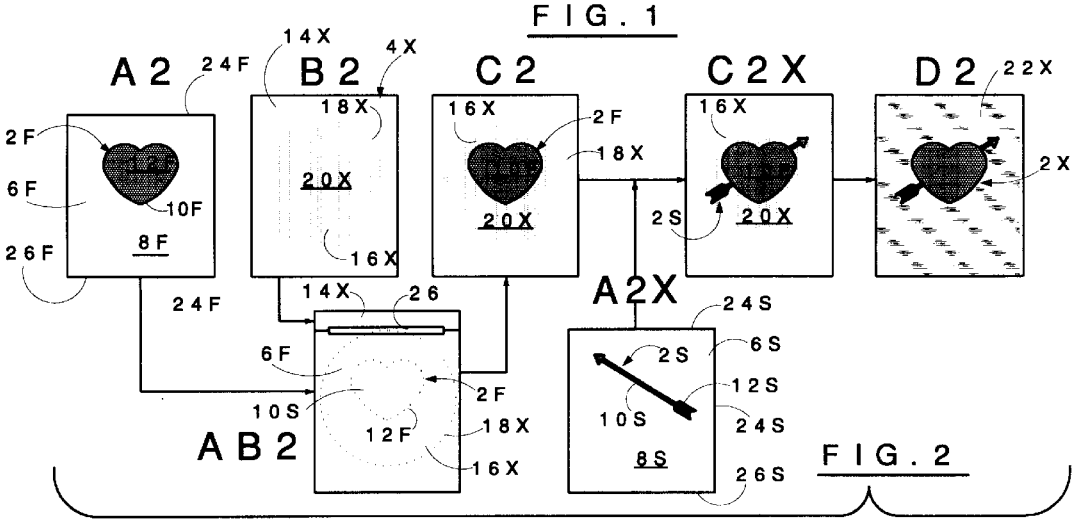
FIG. 2 is a diagrammatic representation similar to FIG. 1 of another embodiment of the invention.
Figure 3:
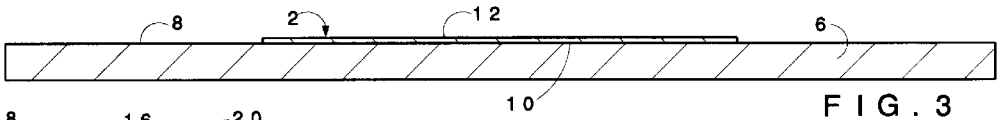
FIG. 3 is sectional view taken on the line III—III of FIG. 1.
Figure 4:
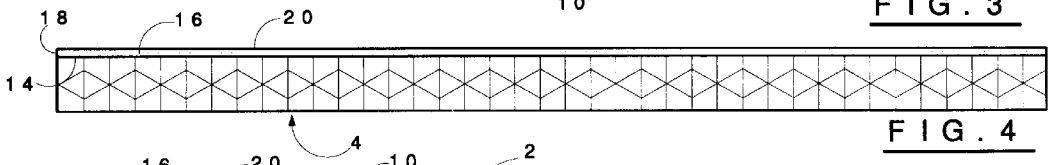
FIG. 4 is sectional view taken on the line IV—IV of FIG. 1.
Figure 5:
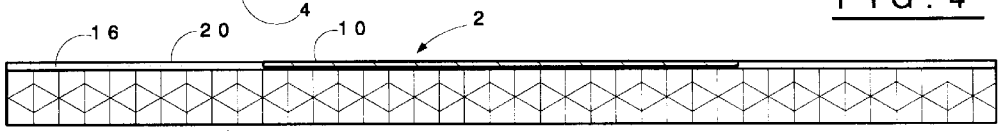
FIG. 5 is sectional view taken on the line V—V of FIG. 1.
Figure 6:
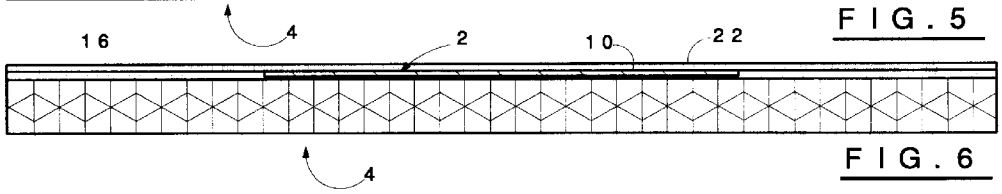
FIG. 6 is sectional view taken on the line VI—VI of FIG. 1.

In another embodiment of the invention shown in FIG. 2, unique dimensional effects can be obtain by use of a plurality of release sheets bearing different designs and applying these seriatim with partial overlap leaving only the overlapped portions of subsequent designs as a permanent part of the final decoration on the finished decorated article. This embodiment comprises providing in step A2 a first release sheet 6F bearing a first design 2F, in step A2X providing a second release sheet 6S bearing a second design 2S, and providing in step B2 a substrate 4X.

The first flat release sheet 6F is defined by a sheet periphery 24F, a release surface 8F and a back surface 26F. Sheet 6F bears the printed design 2F comprising a flat positive image surface 10F in contact with the release surface 8F and an exposed flat mirror image surface 12F.

The second flat release sheet 6S is defined by sheet periphery 24S, a release surface 8S and a back surface 26S. Such second sheet bears the second printed design 2S comprising a flat positive image surface 10S in contact with the release surface 8S and an exposed flat mirror image surface 12S.

In step B2, one applies to exposed surface 14X of substrate 4X a layer 16X of imprint material defined by periphery 18X and an external surface 20X.

In step AB2, one positions the release sheet 6F to overlay the layer of imprint material 16X with the design 2F within the layer periphery 18X and the flat mirror image surface facing the external surface 16X. Also, one secures with strip 26 of adhesive tape a portion of the release sheet periphery 24F relative to the layer periphery 18F leaving the remainder of the release sheet 6S movable relative to the external surface 20X of the layer 16X.

In step C2, one contacts the flat mirror image surface 12F with the external surface 20X and imprints the design 2F into the layer 16X by applying pressure to the back surface of the first release sheet and then removes the release sheet 6F leaving the design 2F imprinted in the layer 16X and the positive image surface 10F of the design 2F exposed.

Using the second release sheet 6S, in a step between A2X and C2X (not shown) that mimics step AB2, one positions the release sheet 6S to overlay the layer 16X of imprint material from step C2 with the design 2S within the layer periphery 18X, secures with a piece of adhesive tape (not shown) a portion of the release sheet periphery 24S relative to the layer periphery 18X leaving the remainder of the release sheet 6S movable relative to the external surface 20X of the layer 16X and contacts at least part of the flat mirror image surface 12S with the external surface 20X.

In step C2X, one imprints that part of the second design 2S that overlaps the design 2F into the layer 16X by applying pressure to the back surface 26S of the release sheet 6S and removes the release sheet 6S leaving the overlap part of the second design 2S imprinted in the layer 16X.

In step D2, one covers with a clear durable coating 22X the finished design 2X, consisting of the full positive image surface 12F plus the overlap part only of the design 2S and all portions of the layer 16X not imprinted by the design 2X.

The basic items needed to produce a decorative design in accordance with the invention are (1) a suitably prepared, exposed substrate surface to be decorated, (2) one or more release sheets bearing a printed mirror image design, (3) a liquid imprint coating composition and (4) a liquid clear surfacing composition.

The substrate bearing the exposed surface can be made of a wide variety of solid materials, e.g., wood, plastic, metal, ceramic, stone, plaster, etc. Typical surfaces would be the portion of a piece of furniture, the walls or ceiling of a room, the metal side of a vehicle, etc. Obviously, the exposed surface should be prepared to be relative smooth and clean, i.e., free of dust, dirt, or other soil. If such surface is unduly porous, it is best to apply a primer/sealer coating to reduce the porosity. In brief, the exposed surface should be treated in known manner needed to prepare it to receive an excellent finished appearance as one would do in preparing a surface to receive a coat of varnish.

A wide variety of primer/sealer coating compositions are commercially available to do the preparation and water base, as opposed to solvent base, compositions are preferred. A neutral white color is usually preferable because the printed designs to be transferred are typically translucent and do not show best over a dark colored substrate surface. However, other colors than white may be used to attain special effects as will be apparent to those skilled in the art of producing decorated substrates. Also, so-called cosolvents, e.g., dipropylene glycol n-propyl ether, may be added in the primer/sealer compositions to promote compatibility with the imprint layer and seal coat layer that will be applied thereover. Further, thickeners used in paints and other coating compositions, e.g., "DP-3" polymer thickener sold by Quality Dye Works Inc., may be included to prevent "running".

Since the final image created in accordance with the invention is the mirror image of the original image printed on the release sheet, it is necessary that such original image be created by computer technology or in other known manner to be the mirror image of the final design to appear on the decorated substrate. If the decorated substrate is to last for many years, e.g., a decorated table top, it is important to select inks or toners used to print the mirror images with care for their longevity. Thus, inks or toners that easily fade in color or hue with age and/or exposure to UV light should be avoided.

The liquid imprint layer compositions to be used in accordance with the invention need to meet several requirements. First, they should be sufficiently fluid to permit their application by brush or spray in the thickness and coverage of a standard "paint job", e.g., a uniform coating of about 1–3 mm. that does not easily "run" beyond the application boundaries. Second, the exposed surface of the layer of the imprint material when dried should be slightly adhesive and preferably will have a peel adhesion value of between about 1–5 oz/in as measured using the ASTM standard test method for peel adhesion D3330-90(Reapproved 1994).

Advantageously, coating compositions used in forming imprint layers in accordance with the invention will comprise a film forming resin or polymer latex (emulsion), a cosolvent and a thickener. Acrylic polymer emulsions are preferred for their durability, etc. and a variety of these are commercially available, e.g., "UNI-REZ" acrylic polymer containing about 50% by weight solids and sp. gr. of 1.04 supplied by Quality Dyeworks Inc.

The clear seal coat compositions to be used in accordance with the invention should advantageously possess several qualities. First, they should be sufficiently fluid to permit their application by brush or spray in the thickness and coverage of a standard "paint job", e.g., a uniform coating of about 1–3 mm. that does not easily "run" beyond the application boundaries. Second, they should be compatible with the imprint layer that they will overlay to mitigate against cracking or hazing as the decorated product made therewith ages. Third, they should be capable of producing a relatively hard, clear finish layer comparable to the finish coat on a fine piece of furniture. A variety of liquid coating composition capable of forming clear substrate finish coats by brush or spray suitable for use in this invention are commercially available. Such products of the water base (emulsion) type are preferred, e.g., an acrylic/styrene resin emulsion marketed under the trademark "UDC 156W" by Morton International Inc. To assist in attaining the desired finish qualities of the seal coat layer of the invention, the seal coat compositions may advantageously contain anti-foaming agents, e.g. BYK 024 , and flow-out agents, e.g., BYK 346 (both available from BYK-Chemie USA).

This invention is illustrated by the following specific examples of production of a decorated substrates in accordance therewith. Such examples are for the purpose of illustration and are not intended to limit the scope of the invention.

EXAMPLE 1

The decoration of the top of an antique wooden table is performed.

An imprint layer composition is prepared by uniformly mixing together in a propeller blade type mixer the following ingredients in the volume quantities indicated:

| | |
|---|---|
| "UNI-REZ" acrylic polymer latex | 3.50 gal. |
| water | 1.75 gal. |
| dipropylene glycol n-propyl ether | 28.0 oz. |
| "DP-3" polymer thickener | 7.0 oz. |

A seal coat composition is prepared by uniformly mixing together in a propeller blade type mixer the following ingredients in the volume quantities indicated:

| | |
|---|---|
| "UDC 156W" acrylic/styrene polymer emulsion | 17.0 gals. |
| water | 15.0 gals. |
| "BYK 024" anti-foaming agent | 6.0 oz. |
| dipropylene glycol n-butyl ether | 1.50 gal. |
| "DP-3" polymer thickener | 12.0 oz. |
| "BYK 346" flow-out agent | 8.0 oz. |

The table top was prepared by removal of an old varnish finish, initially sanded with medium garnet paper and then further sanded with extra fine garnet paper.

A primer coat layer of the aforesaid seal coat composition was uniformly brushed onto the prepared table top and allowed to dry overnight.

An imprint layer of the aforesaid imprint layer composition was uniformly brushed onto the primer coated table top and allowed to dry for two hours.

The first mirror image design of a red heart was printed onto a silicone type release sheet by a computer driven laser printer. A second mirror image design of a multicolored arrow was similarly printed on release paper.

The red heart design was laid face down and centered in the imprint layer on the table top. Pressure was applied via a small roller to the back side of the release sheet to impress the red heart design into the layer coat. Then the release sheet was removed leaving a positive image of the red heart exposed on the table top surrounded by the uncovered portion of the imprint layer.

Next the second release sheet with the mirror image of the arrow was positioned face down over the red heart to so the head and tail portions of the arrow overhung the heart design. In order to retain this position of the second release sheet, a strip of adhesive tape was applied to one edge of the second release sheet and a portion of the imprint layer. Then, pressure was applied via a small roller to the back side of the second release sheet to impress the portions of the arrow design in contact with the imprint layer coat into it. Finally, the release sheet was removed leaving a positive image of only those portions of the arrow that overhung the red heart design exposed on the table top surrounded by the remaining uncovered portion of the imprint layer.

As a concluding step, a uniform coat of the aforesaid seal coat composition was brushed over the entire surface of the table top and allowed to dry overnight. The resulting table top had a shiny, clear surface in which there was a red heart pierced by an arrow that appeared to have been painted on the table top by an artist.

EXAMPLE 2

The decor of a room in a office building is modified by decoration of a wall in the room which had previously been plainly painted overall with acrylic latex paint having an acrylic resin content of about 40% by weight.

An imprint layer liquid composition is prepared by uniformly mixing together in a dispersing blade type mixer the following ingredients in the volume/weight parts indicated in the following table:

| Ingredient | Volume | Weight |
|---|---|---|
| Water | 54.8 | 456 |
| "Carbatol" dry polymer thickener- B F Goodrich Inc. | 3.3 | 7.2 |
| Triethanolamine (99%) | 0.13 | 0.59 |
| Dipropylene glycol, glycobutoxy ether Dow Chemical Co. | 30.0 | 227 |
| "DBE" dibasic ester Union Carbide Inc. | 15.0 | 146 |
| "PN-3" liquid polymer thickener Quality Dye Works Inc. | 0.25 | 1.1 |

An area on the wall four feet high and eight feet wide is selected for decoration with eight spaced-apart separate design images each about 8×10 inches in area.

A single coat of the imprint layer liquid composition, which is a milky liquid having a viscosity characteristic of conventional paint, is applied by brush to the selected wall area. After about one hour, the rectangular area of the acrylic painted wall covered by the imprint layer liquid composition has become mildly tacky to the touch.

Eight silicone type release sheets, each bearing an exposed mirror image of a floral design printed at a separate location on the release side of the sheets by a computer driven laser printer, are separately positioned with the image bearing side of each sheet against a tacky portion of the wall within the rectangular decoration area. Then, the foral design of each sheet is imprinted into the tacky wall surface by hand burnishing the back side of the release sheet with the edge of a paint stir stick. Following the burnishing step, the release sheet is removed leaving the full design image imprinted in the wall.

After application of all eight of the separate images, the decorated wall area is allowed to remain untouched overnight whereupon this wall area, which is then dry and untacky to the touch, provides an improved decor to the room.

What is claimed is:

1. A method for the production of a decorative design on a substrate consisting essentially of in combination the steps of:

providing a non-adhesive design printed on a flat release sheet having a release surface, said design comprising a flat positive image first surface in contact with said release surface and an exposed flat mirror image second surface, applying to an exposed surface of a substrate an imprint layer of imprint material defined by a periphery and an external surface having a peal adhesion value of between about 1 and 5 oz/in., contacting said mirror image second surface with said external surface and imprinting said design into said layer, removing said release sheet leaving said design imprinted in said layer and said positive image first surface of said design exposed, and covering said first surface and any portion of said layer not imprinted by said design with a clear durable coating.

2. The method of claim 1 wherein said release sheet is transparent and comprises a release coating of silicone material.

3. The method of claim 1 wherein said substrate is a portion of a piece of furniture.

4. The method of claim 1 wherein said substrate is a portion of a building wall.

5. The method of claim 1 wherein said imprint material comprises an acrylic polymer.

6. The method of claim 1 wherein a sealing coat is applied to said exposed surface of said substrate prior to said applying of said layer of imprint material.

7. A method for the production of a decorative design on a substrate consisting essentially of in combination the steps of:

providing a non-adhesive design printed on a flat release sheet having a release surface, said design comprising a flat positive image first surface in contact with said release surface and an exposed flat mirror image second surface, applying to an exposed surface of a substrate an imprint layer of imprint material defined by a periphery and a tacky external surface having a peel adhesion value of between about 1 and 5 oz/in., contacting said mirror image second surface with said tacky external surface and imprinting said design into said layer, and removing said release sheet leaving said design imprinted in said layer and said positive image first surface of said design exposed.

8. A method for the production of a decorative design on a substrate consisting essentially of in combination the steps of:

providing a non-adhesive design printed on a flat release sheet defined by a sheet periphery, a release surface and a back surface, said design comprising a flat positive image first surface in contact with said release surface and an exposed flat mirror image second surface, providing a substrate, applying to an exposed surface of said substrate an imprint layer of imprint material defined by an imprint layer periphery and an external surface having a peel adhesion value of between about 1 and 5 oz/in., positioning said release sheet to overlay said layer of imprint material with said design within said layer periphery and said second surface facing said external surface, securing a portion of said sheet periphery relative to said layer periphery leaving the remainder of said release sheet movable relative to said external surface of said layer, contacting said mirror image second surface with said external surface, imprinting said design into said layer by applying transfer pressure to said back surface of said release sheet, removing said release sheet leaving said design imprinted in said layer and with said positive image first surface of said design exposed, and covering said first surface and any portion of said layer not covered by said design with a clear durable coating.

9. The method of claim 8 wherein said said substrate is the top of a table and said clear durable coating is applied to all of said top.

10. A method for the production of a decorative design on a substrate which comprises in combination the steps of:

providing a non-adhesive first design printed on a first flat release sheet defined by a first sheet periphery, a first release surface and a first back surface, said design comprising a first flat positive image surface in contact with said first release surface and an exposed first flat mirror image surface, providing a substrate, applying to an exposed surface of said substrate an imprint layer of imprint material defined by an imprint layer periphery and an external surface having a peel adhesion value of between about 1 and 5 oz/in., positioning said first release sheet to overlay said layer of imprint material with said first design within said layer periphery and said first flat mirror image surface facing said external surface, securing a portion of said first release sheet periphery relative to said layer periphery leaving the remainder of said first release sheet movable relative to said external surface of said layer, contacting said first flat mirror image surface with said external surface, imprinting said first design into said layer by applying pressure to said first back surface of said first release sheet, removing said first release sheet leaving said first design imprinted in said layer and said first positive image surface of said design exposed, providing a non-adhesive second design printed on a second flat release sheet defined by a second sheet periphery, a second release surface and a second back surface, said second design comprising a second flat positive image surface in contact with said second release surface and an exposed second flat mirror image surface, positioning said second release sheet to overlay said layer of imprint material with said second design within said layer periphery and said second flat mirror image surface facing said external surface, securing a portion of said second release sheet periphery relative to said layer periphery leaving the remainder of said second release sheet moveable relative to said external surface of said layer, contacting at least part of said second flat mirror image surface with said external surface, imprinting said at least part of said second design into said layer by applying pressure to said back surface of said second release sheet, removing said second release sheet leaving said at least part of said second design imprinted in said layer while any non-imprinted part of said second design remains on said second release sheet as it is removed, and covering said first positive image surface, said at least part of said second design and any portion of said layer not imprinted by said first and second designs with a clear durable coating.

11. The method of claim 10 wherein at least one additional non-adhesive design printed on an additional flat release sheet is employed therein in a manner like that specified for said non-adhesive second design printed on said second flat release sheet.

* * * * *